US005908227A

United States Patent [19]

Wilhelmstätter et al.

[11] Patent Number: 5,908,227

[45] Date of Patent: Jun. 1, 1999

[54] HOUSEHOLD APPLIANCE

[75] Inventors: Johann Wilhelmstätter, Giengen/Hürben; Helmut Jerg, Giengen; Bernd Schessl, Dillingen; Gerhard Fetzer, Gundelfingen; Michael Hartmann, Höchstädt; Markus Höpfl, Lauingen/Donau; Karl-Heinz Rehm, Dischingen; Rudolf Schmidt, Giengen, all of Germany

[73] Assignee: BSH Bosch und Siemens Hausgeraete GmbH, Munich, Germany

[21] Appl. No.: 08/832,442

[22] Filed: Apr. 3, 1997

[30] Foreign Application Priority Data

Apr. 16, 1996 [DE] Germany ..... 296 06 891 U

[51] Int. Cl.[6] ..... A47B 47/00

[52] U.S. Cl. ..... 312/204; 312/265.5

[58] Field of Search ..... 312/204, 257.1, 312/263, 265.5, 265.6, 223.1, 348.4; 403/329, 326; 52/578, 588.1, 716.1, 718.01, 718.04; 49/501, 70

[56] References Cited

U.S. PATENT DOCUMENTS

| | | | |
|---|---|---|---|
| 3,679,531 | 7/1972 | Wienand et al. | 52/588.1 X |
| 4,732,431 | 3/1988 | Mason | 312/257.1 X |
| 4,850,144 | 7/1989 | Grisham et al. | 49/501 X |

FOREIGN PATENT DOCUMENTS

| | | | |
|---|---|---|---|
| 2350354 | 4/1975 | Germany | 312/204 |
| 3001049 | 7/1981 | Germany | 312/223.2 |
| 3015251 C2 | 9/1988 | Germany . | |
| 2040162 | 8/1980 | United Kingdom | 312/204 |

*Primary Examiner*—Peter M. Cuomo
*Assistant Examiner*—Janet M. Wilkens
*Attorney, Agent, or Firm*—Herbert L. Lerner; Laurence A. Greenberg

[57] ABSTRACT

A household appliance has a panel that is disposed on the front of the appliance and optionally has control and display elements. The panel has a panel body that receives the control and display elements and striplike laminations mounted along a lower peripheral zone of the panel body. In order to ensure that the panel is simple in construction and the laminations can be combined simply and reliably with one another and with the panel body, the laminations are joined to one another and to the panel body solely by a detent device.

12 Claims, 3 Drawing Sheets

HOUSEHOLD APPLIANCE

BACKGROUND OF THE INVENTION

Field of the Invention

The invention relates to a household appliance with a panel that is disposed on the front of the appliance and optionally has control and display elements, the panel has a panel body that receives the control and display elements and striplike laminations mounted along a lower peripheral zone of the panel body.

When household appliances are inserted into a row of kitchen cabinets, it is desirable that the appliances be adapted largely to the adjacent kitchen cabinets in terms of their appearance from the front. To that end, the appliances are lined with plates that correspond in material and appearance to the doors of the kitchen cabinets. A uniform line along the top front of the cabinets, where often a drawer is disposed above a door, is also considered important. Since the panel bodies or drawer front each have different dimensions, depending on the appliance or cabinet manufacturer, the aforementioned laminations are used to compensate for the differences.

To that end, German Patent DE 30 15 251 has proposed a boxlike panel that receives the control and display elements of the household appliance. Its panel body is provided on its underside with striplike laminations extending along the entire width of the panel body. In order to compensate for any difference between the panel body and a furniture panel located below it, the laminations are joined into a unit that produces the appropriate height, and that unit is in turn joined to the panel body. In order to join the individual laminations to one another and to the panel body, the laminations are penetrated by screws on both sides that are screwed into a thread of the panel body. The laminations are all constructed identically, and on their broad sides which do not act as a panel surface, they have grooves and lands, which are joined movably together in a kind of tongue and groove connection. A uniform spacing between the individual laminations is accomplished through the use of compression springs inserted into the interstices among the individual laminations disposed one above the other. The use of screws requires the making of a thread in the panel body and is complicated and expensive. The above-described configuration has the further disadvantage of permitting the screw to be unscrewed far enough that the laminations no longer coincide, and if the screw is unscrewed completely the lamination packet falls apart.

SUMMARY OF THE INVENTION

It is accordingly an object of the invention to provide a household appliance, which overcomes the hereinaforementioned disadvantages of the heretofore-known devices of this general type, which has a panel that is simple in construction and in which laminations of a lamination packet can be combined simply and reliably with one another and with a panel body.

With the foregoing and other objects in view there is provided, in accordance with the invention, a household appliance, comprising an appliance front; a panel disposed on the appliance front, the panel having a panel body for receiving control and display elements, the panel body having a lower peripheral zone; striplike laminations mounted along the lower peripheral zone; and a detent device, the laminations being joined to one another and to the panel body solely by the detent device.

The use of screws is avoided through the use of the detent device according to the invention. Therefore it is also unnecessary to make a thread in the panel body. Thus a household appliance of the type referred to at the outset is created in a simple way in which the panel is simple in construction and the laminations of the packet can be combined simply and reliably with one another and with the panel body.

In accordance with another feature of the invention, a maximum vertical reciprocation of the laminations is limited by the detent device, thus overcoming a further disadvantage of the above-described prior art and further improving the security with which the lamination packet is joined together.

In accordance with a further feature of the invention, the detent device has vertically projecting spring hooks, which protrude through openings of the next lamination in sequence and rest with their protruding hook on an edge at the opening, in an installed state. With this embodiment, a structure of the detent device according to the invention is created that is especially easy to assembly and easy to produce.

In accordance with an added feature of the invention, the spring hooks in the installed state project upward and protrude through openings in the above-disposed lamination or in the panel body, thus further facilitating the assembly of the panel.

In accordance with an additional feature of the invention, further economy in production is attained if the laminations are substantially identical in shape.

In accordance with yet another feature of the invention, an especially simple construction of the laminations is assured if the laminations are assembled in crimped-over internested fashion.

In accordance with yet a further feature of the invention, as is known per se, the laminations are pressed apart by elastic elements, and preferably the elastic elements are each at least one spring made in one piece with the lamination.

In accordance with yet an added feature of the invention, guidance of the vertically displaceable laminations is attained by providing the laminations with vertically projecting guide domes, which protrude through openings of the next lamination in sequence.

In accordance with yet an additional feature of the invention, the guide domes in the installed state project upward and protrude through openings in the lamination disposed above or in the panel body, thus making assembly of the panel even easier.

In accordance with again another feature of the invention, the guide domes are constructed as hollow cylinders. Economy in terms of the material used and its weight is expediently attained with this feature.

In accordance with a concomitant feature of the invention, the laminations are made in one piece from a plastic, which represents a further simplification of the production of the panel.

Other features which are considered as characteristic for the invention are set forth in the appended claims.

Although the invention is illustrated and described herein as embodied in a household appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
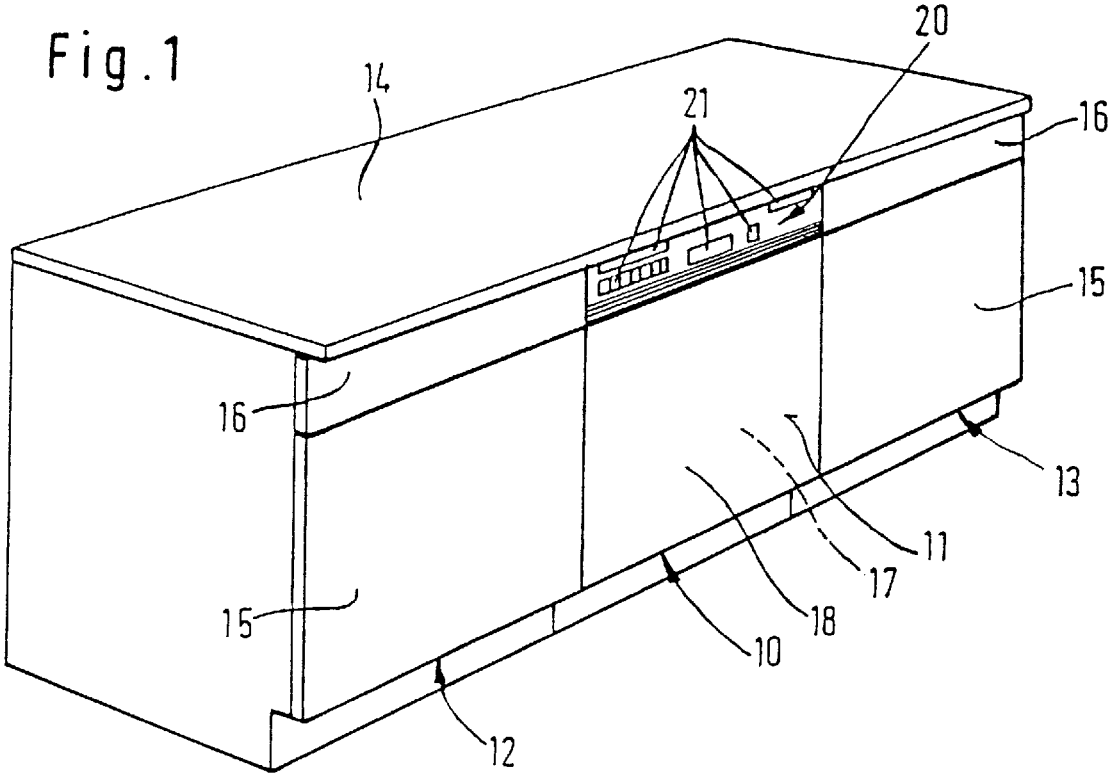
FIG. 1 is a diagrammatic, perspective view of a row of kitchen cabinets with a built-in household appliance of the invention.

Referring now to the figures of the drawings in detail and first, particularly, to FIG. 1 thereof, there is seen a household appliance that is a household dishwasher 10 in the illustrated exemplary embodiment, which has a front side disposed flush between two adjacent under counter kitchen cabinets 12, 13, and which is covered by a common countertop 14 together with the cabinets. In order to make a front 11 of the appliance match the appearance of the cabinets 12, 13, each of which has a door 15 and a drawer panel 16, the household dishwasher 10 has a front plate 18 of wood placed in front of its door 17.

Figure 2:
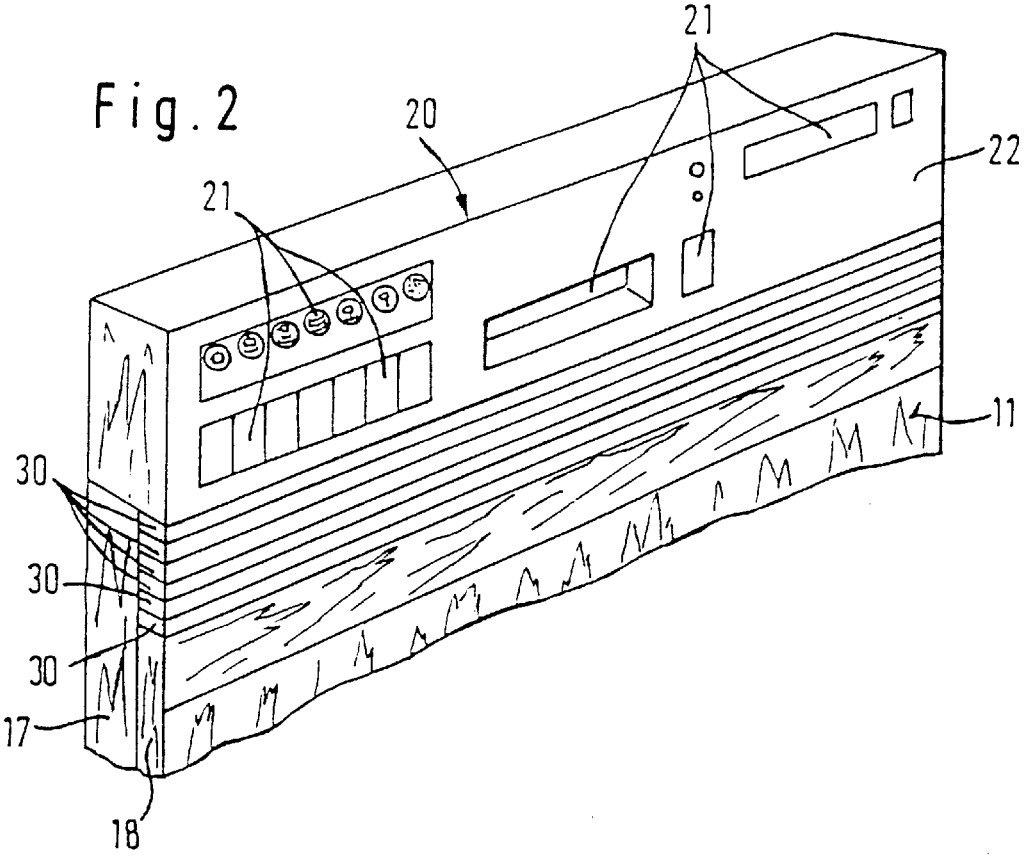
FIG. 2. is a fragmentary, perspective view of an upper portion of a door of the household appliance of the invention.
Figure 3:
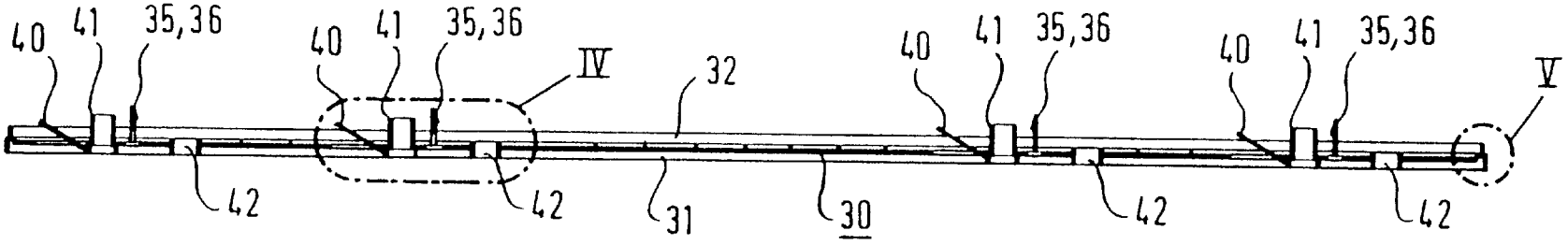
FIG. 3 is a sectional view through a side of a lamination according to the invention.

The door 17 is provided with a panel 20 that holds control and display elements 21, in the region of an upper peripheral zone of the front 11 of the appliance or machine 10. As is seen in FIG. 2, the panel 20 according to the invention includes a panel body 22 that receives the control and display elements 21 and striplike laminations 30 mounted along a lower edge zone of the panel body 22.

Figure 5:
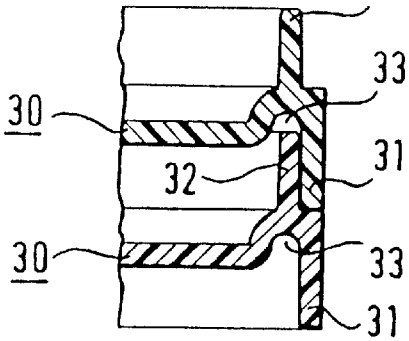
FIG. 5 is an enlarged, fragmentary view of a portion V of FIG. 3 with assembled laminations.
Figure 4:
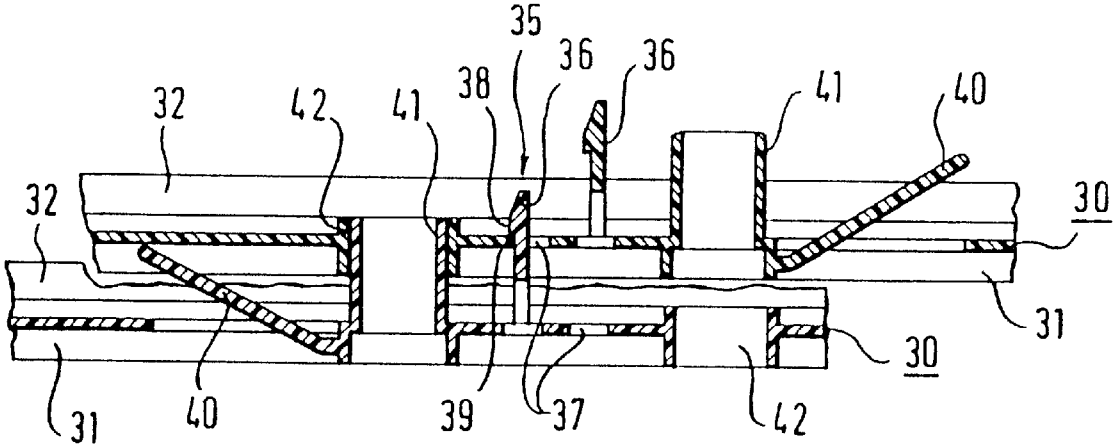
FIG. 4 is an enlarged, fragmentary view of a portion IV of FIG. 3 with assembled laminations.

As can be best seen in FIG. 4, the laminations 30 are disposed vertically displaceably in one another. As is best seen in FIG. 5, in an assembled state, an encompassing lower edge 31 surrounds an encompassing upper edge 32 of the lamination 30 mounted beneath it, and each lamination 30 has an encompassing groove 33 that can receive the encompassing upper edge 32 of the lamination 30 mounted beneath it. In FIG. 5, two joined-together laminations 30 are shown in a position in which they are pushed maximally close together.

According to the invention, the laminations 30 are joined solely by a detent device 35 to one another and to the panel body 22. The maximum vertical reciprocation of the laminations 30 is limited by the detent device 35. The detent device 35 has vertically projecting spring hooks 36 (projecting upward in the illustrated exemplary embodiment), which protrude through openings 37 in the next lamination 30 (which is the lamination located above in the illustrated exemplary embodiment) and rest with a protruding hook 38 thereof on an edge 39 at the opening 37 in the installed state, and thus limit the maximum vertical reciprocation of the laminations 30. In FIG. 4, two joined-together laminations 30 are shown in their farthest position, that is with their maximum vertical reciprocation.

The laminations 30 are substantially identical in shape, and as is best seen in FIG. 4, the laminations 30 are assembled in crimped-over internested fashion.

The laminations 30 are pressed apart by elastic elements 40, which are each constructed as at least one spring, in this case four springs, that are made in one piece with the lamination 30.

In order to guide the vertically displaceable laminations 30 in the illustrated exemplary embodiment, they have vertically upwardly projecting guide domes 41, which protrude through openings 42 of the next lamination 30 (which is the one above in the exemplary embodiment). This is possible because of the internested laminations 30. In order to save material, the guide domes 41 are constructed as hollow cylinders.

In the illustrated exemplary embodiment, the laminations 30 are made in one piece from a plastic.

With the configuration described above, a household appliance 10 of the type referred to at the outset is created in which the panel 20 is simple in construction and the laminations of the packet can be combined simply and reliably with one another and with the panel body 22.

Figure 6:
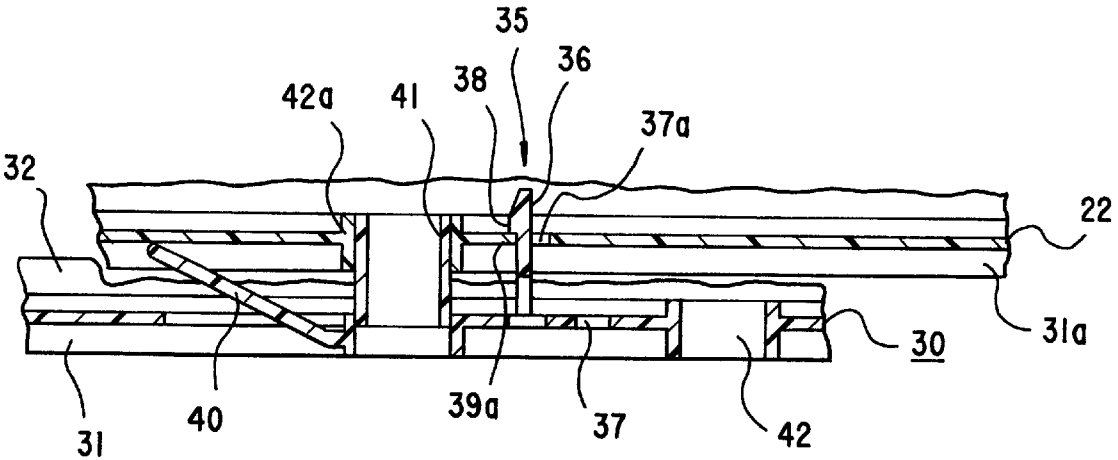
FIG. 6 is an enlarged, fragmentary view of a portion IV of the lamination of FIG. 3, shown mounted to a panel body.

The manner previously described with reference to FIG. 4 for joining two laminations 30 together is analogous to the manner in which a lamination 30 can be joined to the panel body 22. FIG. 6 shows the striplike lamination 30 disposed vertically displaceably in the panel body 22. The detent device 35 with its vertically projecting spring hook 36 protrudes through the opening 37*a* in the panel body 22. FIG. 6 specifically illustrates an installed state in which the lamination 30 rests with the protruding hook 38 thereof on an edge 39*a* at the opening 37*a* of the panel body 22, and the maximum vertical displacement of the lamination 30 with respect to the panel body 22 is thereby limited. In the exemplary embodiment, the guide dome 41 of the lamination 30 protrudes through the opening 42*a* of the panel body 22 to guide the lamination.

Figure 7:
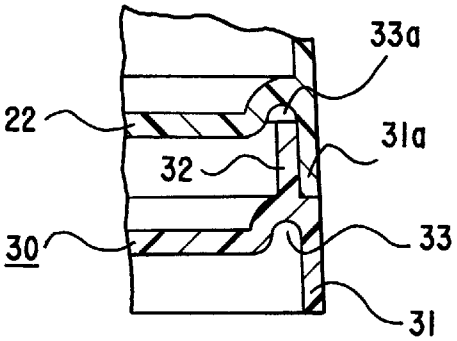
FIG. 7 is an enlarged, fragmentary view of a portion V of the lamination of FIG. 3, shown mounted to the panel body.

As is best seen in FIG. 7, in an assembled state, an encompassing lower edge 31*a* of the panel body 22 surrounds the encompassing upper edge 32 of the lamination 30 mounted beneath it. The panel body 22 has an encompassing groove 33*a* that can receive the encompassing upper edge 32 of the lamination 30 mounted beneath it. In FIG. 7, the lamination 30 and the panel body 22 are shown in a position in which they are joined and pushed maximally close together.

We claim:

1. A household appliance, comprising:

an appliance front;

a panel disposed on said appliance front, said panel having a panel body for receiving control and display elements;

at least a first striplike lamination, including at least one detent, said lamination vertically displaceably mounted to said panel body by said at least one detent, and said lamination including at least one elastic element being a spring formed in one piece with said lamination for vertically displacing said lamination away from said panel body.

2. The household appliance according to claim 1, wherein said first striplike lamination has a maximum vertical displacement with respect to said panel body and said at least one detent limits said maximum vertical displacement.

3. The household appliance according to claim 1, wherein said first striplike lamination is made in one piece from plastic.

4. A household appliance, comprising:

an appliance front;

a panel disposed on said appliance front, said panel having a panel body for receiving control and display elements;

at least a first striplike lamination, including at least one detent, said first striplike lamination vertically displaceably mounted to said panel body by said at least one detent;

at least a second striplike lamination mounted to said panel body, said second striplike lamination having at least one opening formed therein;

said detent of said first striplike including a vertically projecting hook; and said hook of said first lamination vertically projecting through said at least one opening formed in said second striplike lamination.

5. The household appliance according to claim 4 wherein:

said panel body has at least one opening formed therein which defines an edge;

said second striplike lamination includes a detent having a vertically projecting hook; and said vertically projecting hook of said second striplike lamination vertically projects through said at least one opening in said panel body.

6. The household appliance according to claim 4, wherein said laminations are substantially identical in shape.

7. The household appliance according to claim 4, wherein said laminations are assembled in crimped-over internested fashion.

8. The household appliance according to claim 4, wherein:

said opening of said second striplike lamination defines an edge; and said first striplike lamination is displaceable to a position of maximum vertical displacement with respect to said panel body in which said hook of said first striplike lamination rests on said edge of said second lamination.

9. A household appliance, comprising:

an appliance front;

a panel disposed on said appliance front, said panel having a panel body for receiving control and display elements;

at least a first striplike lamination, including at least one detent, said first striplike lamination vertically displaceably mounted to said panel body by said at least one detent;

at least a second striplike lamination having at least one opening formed therein;

said first striplike lamination including at least one vertically projecting guide dome; and said guide dome protruding through said opening formed, in said second striplike lamination.

10. The household appliance according to claim 9, wherein:

said panel body has at least one opening formed therein;

said second striplike lamination includes at least one vertically projecting guide dome;

said guide dome of said second lamination projects upward and protrudes through said opening formed in said panel body.

11. The household appliance according to claim 10, wherein said guide dome of said first lamination and said guide dome of said second lamination are hollow cylinders.

12. The household appliance according to claim 9, wherein said guide dome is a hollow cylinder.

* * * * *